US007189091B1

(12) United States Patent
Montena

(10) Patent No.: US 7,189,091 B1
(45) Date of Patent: Mar. 13, 2007

(54) COAXIAL CABLE COUPLING NUT

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/253,843

(22) Filed: Oct. 19, 2005

(51) Int. Cl.
*H01R 13/62* (2006.01)
*H01R 9/05* (2006.01)

(52) U.S. Cl. ..... 439/322; 439/578; 439/385

(58) Field of Classification Search ..... 439/322, 439/320, 385, 578, 579
See application file for complete search history.

(56) References Cited

U.S. PATENT DOCUMENTS 5,062,808 A * 11/1991 Hosler, Sr. ..... 439/580
5,183,411 A 2/1993 Yu
5,393,244 A 2/1995 Szegda
5,435,745 A 7/1995 Booth
5,474,478 A 12/1995 Ballog
5,556,292 A 9/1996 Kato et al.
5,667,405 A 9/1997 Holliday
5,829,998 A * 11/1998 Wandler et al. ..... 439/312
6,183,298 B1 2/2001 Henningsen
6,824,392 B1 * 11/2004 Guo ..... 439/63
6,848,920 B2 2/2005 Fox
6,910,910 B2 * 6/2005 Cairns ..... 439/352
2005/0164552 A1 7/2005 Wlos et al.

* cited by examiner

*Primary Examiner*—Hien Vu
(74) *Attorney, Agent, or Firm*—Pastel Law Firm; Christopher R. Pastel

(57) ABSTRACT

A hybrid coupling nut for a cable connector includes a plurality of fingers on a friction sleeve portion of the nut with a plurality of threads adjacent the fingers inside the nut. An annular knurled portion on the nut adjacent the fingers on the outside of the nut assist a user in connecting the nut to an RF port. Each finger includes a beveled edge. The nut also includes an annular flange for rotatably connecting the coupling nut to the cable connector.

6 Claims, 2 Drawing Sheets

COAXIAL CABLE COUPLING NUT

FIELD OF THE INVENTION

This invention relates generally to the field of cable television (CATV) connectors, and more particularly to a coaxial cable coupling nut that is a hybrid of a push-on type and a fully threaded type.

BACKGROUND OF THE INVENTION

A significant portion of unwanted interference entering a CATV system is let in by loose connectors within a subscriber's home. Standard threaded F-connectors often are not fully tightened because the number of full turns necessary for full tightening are more than are practical to turn by hand. Commercially available push-on type connectors are not an adequate substitute because they often do not have enough retention force to remain securely in place.

SUMMARY OF THE INVENTION

Briefly stated, a hybrid coupling nut for a cable connector includes a plurality of fingers on a friction sleeve portion of the nut with a plurality of threads adjacent the fingers inside the nut. An annular knurled portion on the nut adjacent the fingers on the outside of the nut assist a user in connecting the nut to an RF port. Each finger includes a beveled edge. The nut also includes an annular flange for rotatably connecting the coupling nut to the cable connector.

According to an embodiment of the invention, a coupling nut for a cable connector includes a friction sleeve portion of the nut; the friction sleeve portion including a smooth portion on an inside of the nut; a threaded portion on an inside of the nut adjacent the smooth portion; and a plurality of slots parallel to a longitudinal axis of the nut, wherein the plurality of slots define a plurality of fingers in the friction sleeve portion.

According to an embodiment of the invention, a method of manufacturing a coupling nut for a cable connector includes the steps of (a) forming a friction sleeve portion of the nut which includes a smooth portion on an inside of the nut; (b) forming a threaded portion on an inside of the nut adjacent the smooth portion; and (c) forming a plurality of slots parallel to a longitudinal axis of the nut, wherein the plurality of slots define a plurality of fingers in the friction sleeve portion of the nut.

DETAILED DESCRIPTION OF THE PREFERRED EMBODIMENT

Figure 1:
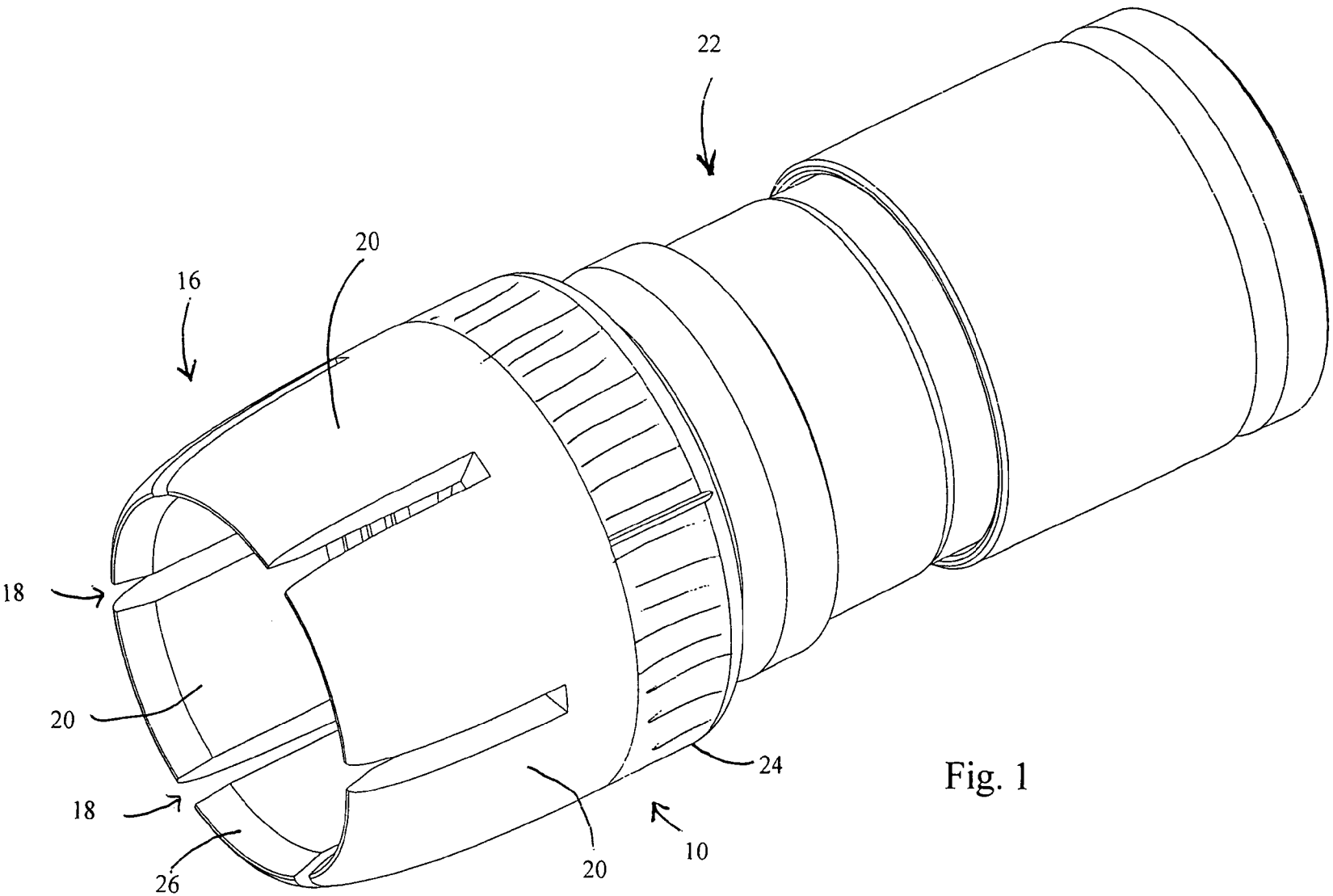
FIG. 1 shows a perspective view of a hybrid coupling nut for a cable connector according to an embodiment of the invention.

Referring to FIG. 1, a cable connector 22 is shown which includes a coupling nut 10 and a remainder part according to an embodiment of the invention. Although cable connector 22 is shown as a compression-type connector, coupling nut 10 works with any type of cable connector. Cable coupling nut 10 is a hybrid of a push-on type and a fully threaded type. A friction sleeve portion 16 includes a plurality of slots 18 which define a plurality of fingers 20. Fingers 20 preferably include a beveled edge 26 to guide fingers 20 as they fit over an RF port (not shown) to which nut 10 is being connected.

Figure 2:
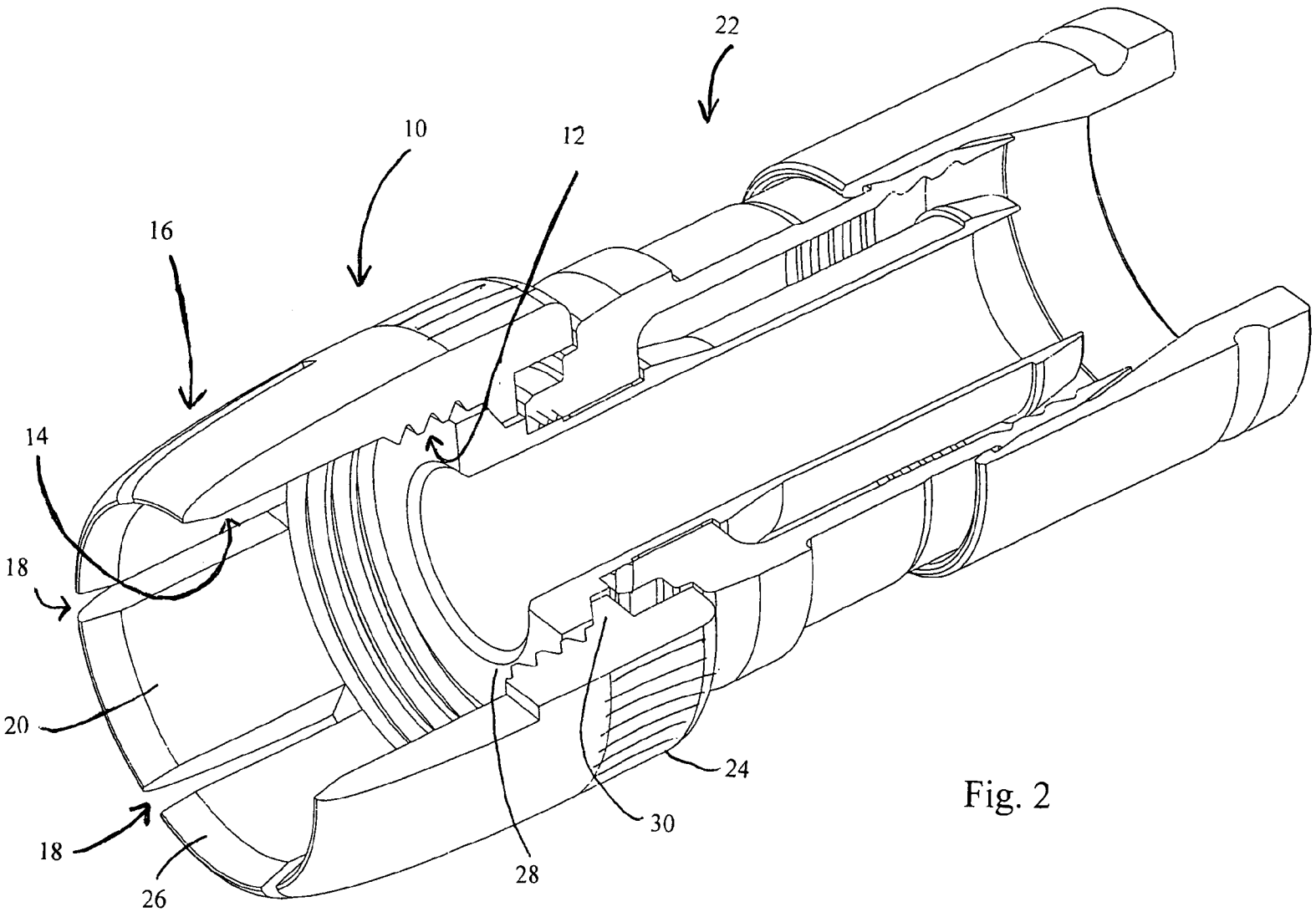
FIG. 2 shows a partially cutaway perspective view of the hybrid coupling nut of FIG. 1.

Referring also to FIG. 2, friction sleeve portion 16 also includes a smooth surface portion 14 on an inside of nut 10. Friction sleeve portion 16 operates as a resilient finger push-on section which provides a friction fit to the RF port (not shown) that nut 10 connects to, while also aligning the connector axis of cable connector 22 to the RF port threads. Nut 10 includes a threaded portion 12 which contains sufficient, and preferably just enough, full threads, e.g., 2–3 full threads, to provide firm mechanical engagement and RF sealing to the RF port with only a full turn of coupling nut 10. A knurled annular section 24 is preferably on part of an outside of nut 10 to assist in gripping nut 10 with one's fingers. Conventional wrench flats optionally replace knurled annular section 24. An annular flange 30 cooperates with cable connector 22 to connect nut 10 rotatably to cable connector 22.

During use, a user pushes nut 10 onto an RF port, initially causing beveled edge 26 to engage the RF port, and then causing fingers 20 to engage with the RF port in an interference fit. As fingers 20 engage with the RF port, coupling nut 10 become aligned with the longitudinal axis of cable connector 22, so that fingers 20 are fully engaged with the RF port. This alignment permits the user to easily engage threaded portion 12. The user rotates coupling nut 10 between approximately one-half and one full turn as threads 12 engage with corresponding threads (not shown) on the RF port, thus bottoming the RF port on a ground contact 28 of connector 22.

Coupling nut 10 is of a conductive material, such as metal, conductive plastic, or conductive ceramic so as to insure good ground connectivity between the ground of the RF port and ground contact 28. Metal is preferred due to its resistance to environmental conditions and excellent electrical conductivity. Coupling nut 10 is optionally of non-conductive plastic, but in this case, proper installation is critical to insure that the ground of the RF port makes good physical and electrical contact with ground contact 28 of cable connector 22.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A cable connector for connecting a coaxial cable onto a port, wherein the cable connector consists of a coupling nut and a remainder part, comprising:

the nut including a friction sleeve portion at a front end of the nut;

the friction sleeve portion including a smooth portion on an inside of the nut;

a threaded portion on an inside of the nut adjacent the smooth portion, a rear portion of the nut being connected at a front end of the remainder part; and a plurality of slots parallel to a longitudinal axis of the nut, wherein the plurality of slots define a plurality of fingers in the friction sleeve portion;

wherein, when the nut is connected onto the port, both the friction sleeve portion and the threaded portion make electrical and physical contact with the port; and wherein an end of each finger includes a beveled edge.

2. A coupling nut according to claim 1, further comprising a knurled portion on an outside of the nut at an end of the nut opposite an end of the nut containing the plurality of fingers.

3. A coupling nut according to claim 1, further comprising means for rotatably connecting the coupling nut to a cable connector.

4. A method of manufacturing a cable connector for connecting a coaxial cable onto a port, wherein the cable connector consists of a coupling nut and a remainder part, comprising the steps of:

forming the coupling nut and forming the remainder portion;

attaching a rear portion of the coupling nut to a front end of the remainder part;

forming a friction sleeve portion of the nut which includes a smooth portion on an inside of the nut;

forming a threaded portion on an inside of the nut adjacent the smooth portion; and forming a plurality of slots parallel to a longitudinal axis of the nut, wherein the plurality of slots define a plurality of fingers in the friction sleeve portion of the nut;

forming a beveled edge on an end of each finger;

wherein, when the nut is connected onto the port, both the friction sleeve portion and the threaded portion make electrical and physical contact with the port.

5. A method according to claim 4, further comprising the step of forming a knurled portion on an outside of the nut at an end of the nut opposite an end of the nut containing the plurality of fingers.

6. A method according to claim 4, further comprising forming an annular flange on the nut for rotatably connecting the coupling nut to a cable connector.

* * * * *